US008286284B2

(12) United States Patent
Fee et al.

(10) Patent No.: US 8,286,284 B2
(45) Date of Patent: Oct. 16, 2012

(54) RAPID INTERVENTION DRAG STRETCHER DEVICES

(75) Inventors: Thomas J. Fee, South Hempstead, NY (US); Frank Haskell, West Islip, NY (US); Michael P. Harty, West Islip, NY (US)

(73) Assignee: MFT Internal Inc., West Islip, NY (US)

( * ) Notice: Subject to any disclaimer, the term of this patent is extended or adjusted under 35 U.S.C. 154(b) by 135 days.

(21) Appl. No.: 12/025,028

(22) Filed: Feb. 2, 2008

(65) Prior Publication Data

US 2008/0184488 A1 Aug. 7, 2008

Related U.S. Application Data

(60) Provisional application No. 60/980,768, filed on Oct. 17, 2007, provisional application No. 60/887,932, filed on Feb. 2, 2007.

(51) Int. Cl.
*A61G 7/10* (2006.01)

(52) U.S. Cl. ..... 5/628; 5/89.1 T

(58) Field of Classification Search ..... 5/627–628, 5/625, 89.1, 81.1 T; 182/3
See application file for complete search history.

(56) References Cited

U.S. PATENT DOCUMENTS

| | | | | |
|---|---|---|---|---|
| 722,456 | A | | 3/1903 | Reeves |
| 2,279,694 | A | | 4/1942 | Martinson |
| 2,788,530 | A | | 4/1957 | Ferguson |
| 2,899,692 | A | | 8/1959 | Finken |
| 3,158,875 | A | | 12/1964 | Fletcher |
| 3,424,134 | A | * | 1/1969 | Rosenblum ..... 182/3 |
| 4,124,908 | A | | 11/1978 | Burns et al. |
| 4,283,068 | A | * | 8/1981 | Keyser ..... 280/19 |
| 4,970,739 | A | | 11/1990 | Bradford |
| 5,027,833 | A | | 7/1991 | Calkin |
| 5,044,031 | A | | 9/1991 | Sherwood et al. |
| 5,050,254 | A | | 9/1991 | Murphy |
| 5,058,575 | A | | 10/1991 | Anderson |
| 5,121,514 | A | | 6/1992 | Rosane |
| 5,189,746 | A | * | 3/1993 | Horie ..... 5/627 |
| 5,539,945 | A | | 7/1996 | Rosenberg et al. |
| 5,701,619 | A | | 12/1997 | Ullman |
| 5,720,303 | A | | 2/1998 | Richardson |
| 5,729,850 | A | | 3/1998 | Eskeli |

(Continued)

FOREIGN PATENT DOCUMENTS

EP 0 301 614 A1 2/1989

(Continued)

OTHER PUBLICATIONS

PCT International Search Report for International Application No. PCT/US2008/052868 dated Jul. 14, 2008.

(Continued)

*Primary Examiner* — Fredrick Conley
(74) *Attorney, Agent, or Firm* — The Farrell Law Firm, P.C.

(57) ABSTRACT

Emergency drag stretcher devices are provided that include a combination of a base panel formed of a flexible sheet material, and a unitary harness device coupled to the base panel, wherein the unitary harness system is adapted to securely restrain an individual and hold the base panel against the individual, and allow the individual to be dragged or vertically lifted using the emergency stretcher device.

10 Claims, 9 Drawing Sheets

U.S. PATENT DOCUMENTS

| | | | | |
|---|---|---|---|---|
| 5,787,529 | A | 8/1998 | Landes | |
| 5,839,137 | A | 11/1998 | Butler et al. | |
| 5,960,480 | A * | 10/1999 | Neustater et al. | 2/456 |
| 5,978,989 | A | 11/1999 | Chavez | |
| 6,634,044 | B1 | 10/2003 | Wright | |
| 6,871,368 | B2 | 3/2005 | Calkin | |
| 6,880,702 | B1 | 4/2005 | Colorado | |
| 7,086,091 | B2 | 8/2006 | Jordan | |
| 7,168,110 | B2 * | 1/2007 | Girard et al. | 5/89.1 |
| 2004/0128767 | A1 | 7/2004 | Hood | |
| 2006/0061050 | A1 | 3/2006 | Wolf et al. | |
| 2006/0169534 | A1 | 8/2006 | Green | |
| 2008/0018067 | A1 | 1/2008 | Small | |

FOREIGN PATENT DOCUMENTS

| | | |
|---|---|---|
| EP | 1 400 227 A1 | 3/2004 |
| GB | 1536191 | 12/1978 |

OTHER PUBLICATIONS

PCT Written Opinion of the International Searching Authority for International Application No. PCT/US2008/052868 dated Jul. 14, 2008.

* cited by examiner

RAPID INTERVENTION DRAG STRETCHER DEVICES

CROSS-REFERENCE TO RELATED APPLICATIONS

This application claims priority to U.S. Provisional Application Ser. No. 60/980,768 filed on Oct. 17, 2007 and U.S. Provisional Application Ser. No. 60/887,932 filed on Feb. 2, 2007, which are both fully incorporated herein by reference.

TECHNICAL FIELD

The present invention relates generally to emergency rescue stretcher devices that enable rapid removal of injured persons from a hazardous location and, more specifically, emergency stretcher devices that include a combination of a base panel formed of a flexible sheet material, and a unitary harness device coupled to the base panel, wherein the unitary harness device is adapted to securely restrain an individual and allow the individual to be dragged or vertically lifted using the emergency stretcher device.

BACKGROUND

Emergency stretchers are commonly employed in emergencies to quickly move an injured person to safety (e.g., moving a downed firefighter from a burning building, moving an injured soldier from the battlefield, etc.). Rescue stretchers are typically constructed using some type of body support member and a complex system of individual straps that are fixedly attached at various positions over the body support member to secure and restrain an individual on or within the body support member. Such rescue stretcher designs are problematic for various reasons.

For instance, the complex strapping configurations for such devices require manual engagement of many fasteners and various adjustments to the straps, which can be burdensome and time consuming. Indeed, in emergencies, there may not be time to fully or properly engage every strap of the rescue stretcher device or make the proper adjustments to properly secure the person in the rescue stretcher. Moreover, such rescue stretcher devices typically utilize the body support member as a primary means for securely restraining the body of the individual during a lifting or dragging operation of the stretcher, while the strapping systems merely secure the individual on or within the body support member. With such rescue stretcher devices, the body support members are typically designed having complex, elaborate frameworks that are bulky and heavy, which places practical limitations on the manner in which such devices can be used. For example, when used by military and rescue worker personnel, it can be difficult to carry such bulky and heavy rescue stretchers to a location that cannot be reached by a rescue vehicle to reach an injured person, or otherwise manipulate, drag or haul an individual on the rescue stretcher in or through constrained spaces.

SUMMARY

Exemplary embodiments of the invention include improved lightweight, compact rescue stretcher devices that can be used by military personnel, rescue workers and emergency first responders for purposes of rescue evacuation and other emergency use such as transporting, dragging or lifting injured individual to safety. More specifically, exemplary embodiments of the invention include emergency drag stretcher devices that include a combination of a base panel formed of a flexible sheet material, and a unitary harness device coupled to the base panel, wherein the unitary harness system is adapted to securely restrain an individual and hold the base panel against the individual, and allow the individual to be dragged or vertically lifted using the emergency stretcher device.

In one exemplary embodiment of the invention, a rescue stretcher device includes a base panel formed of flexible sheet material, a unitary harness device coupled to the base panel, wherein the unitary harness device is adapted to securely restrain an individual and hold the base panel against the individual, and a pull handle for pulling the rescue stretcher device, wherein the pull handle is coupled to the unitary harness device so that pulling forces are directly exerted on the unitary harness device in which the individual is securely restrained. The unitary harness device may be a full body harness having a unitary harness strap framework including groin, shoulder and waist straps with mating fasteners attached to the connecting ends of the harness straps for releasably connecting the ends of the groin, shoulder and waist straps and thereby secure an individual within the fully body harness. The pull handle may be formed by one or more harness straps that are integrally formed as part of the unitary full body harness device.

In other exemplary embodiments of the invention, a unitary harness device includes a harness bag within which the harness body straps may be stored and protected during periods of non-deployment of the harness device. The harness bag comprises a plurality of reinforced slots/slits through which the end portions of the various harness straps (haul straps, shoulder straps, waist straps and groin straps) with mating fasteners are extended from within the interior of the harness bag. During periods of non-deployment of the harness device, excess slack of the various harness straps may be releasably held within the harness bag while the connecting ends of the harness straps with mating fasteners are releasably held in place on the exterior surface of the harness bag. When deploying the harness device, the end portions of the harness straps can be pulled to extract the excess slack within the harness bag and affix the harness straps around the individual being restrained in the harness device.

These and other exemplary embodiments, aspects, features and advantages, of the present invention will become apparent from the following detailed description of exemplary embodiments, that is to be read in connection with the accompanying drawings.

DETAILED DESCRIPTION OF EXEMPLARY EMBODIMENTS

Figure 1:
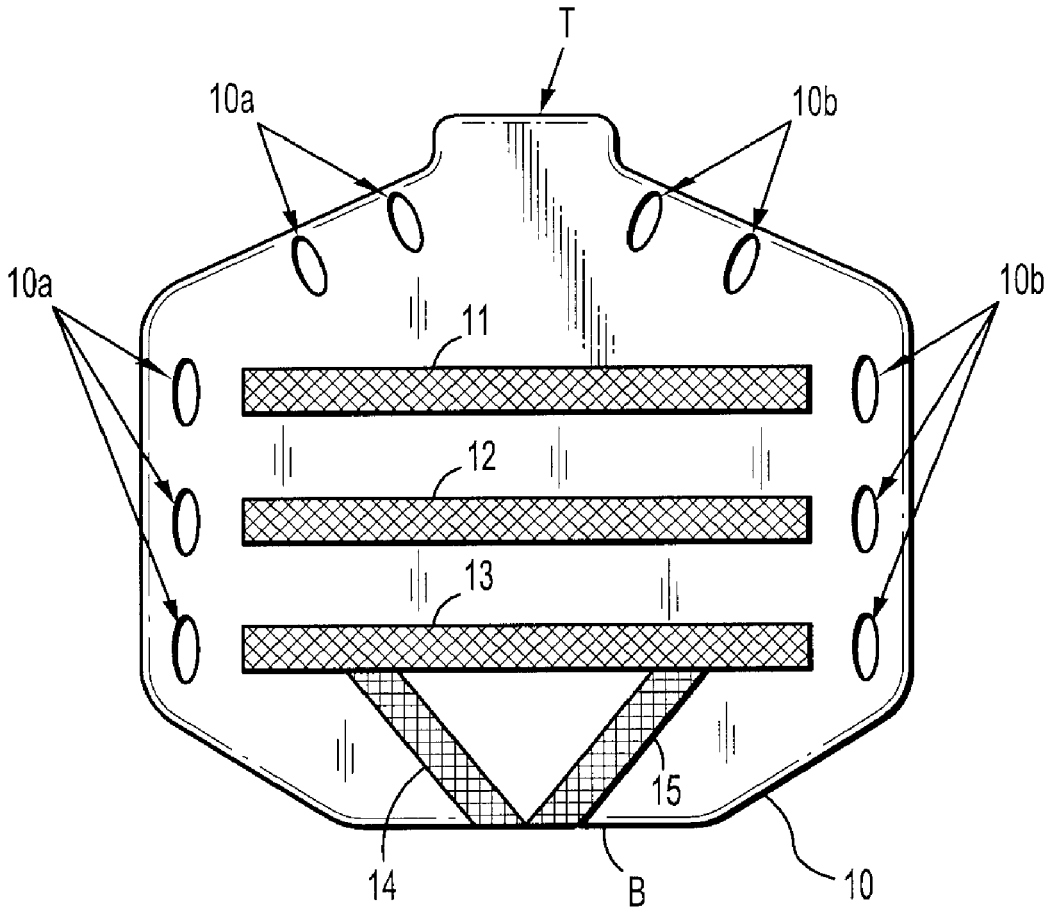
FIG. 1 is a schematic plan view of a base panel portion of a drag stretcher device according to an exemplary embodiment of the invention.
Figure 2:
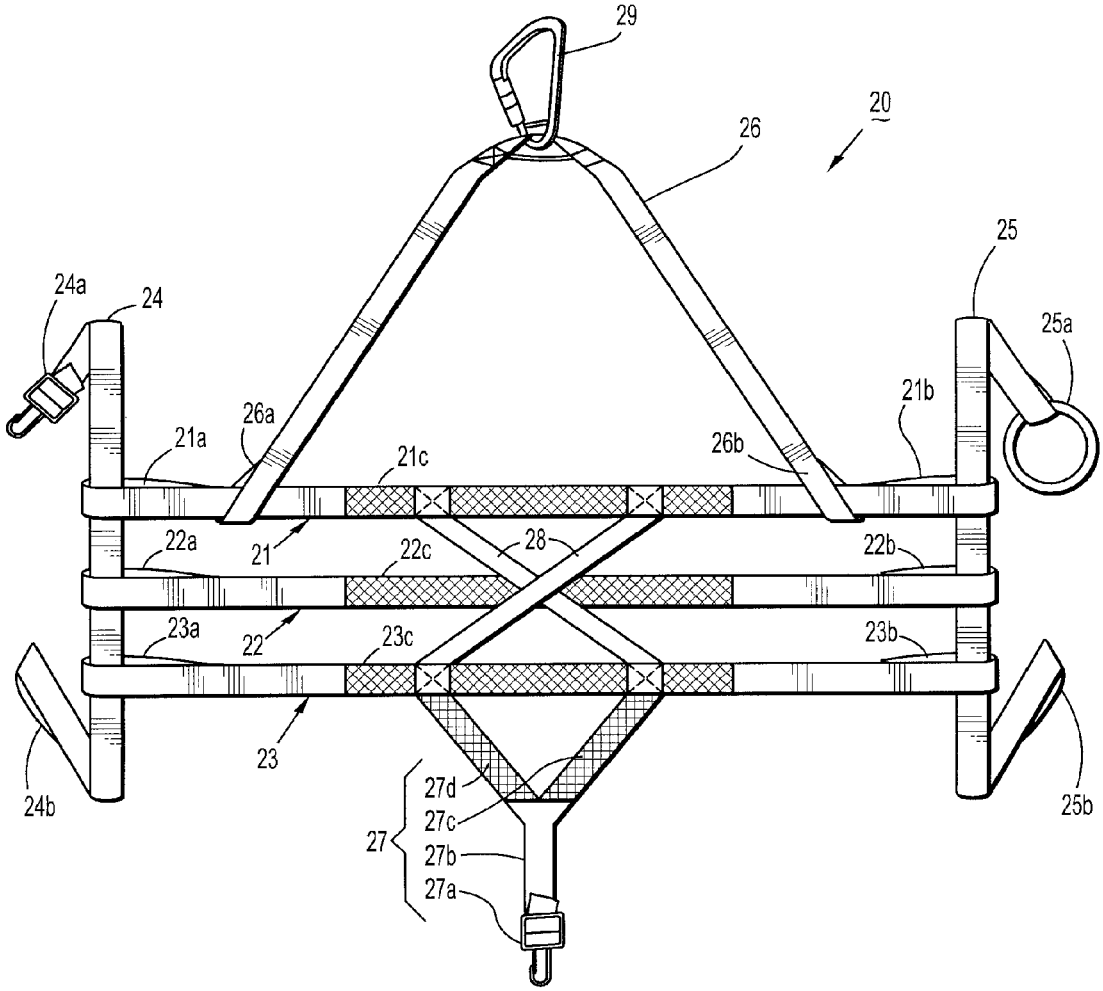
FIG. 2 schematically illustrates a unitary harness device according to an exemplary embodiment of the invention, which is adapted for use with the exemplary base panel portion of FIG. 1.
Figure 3:
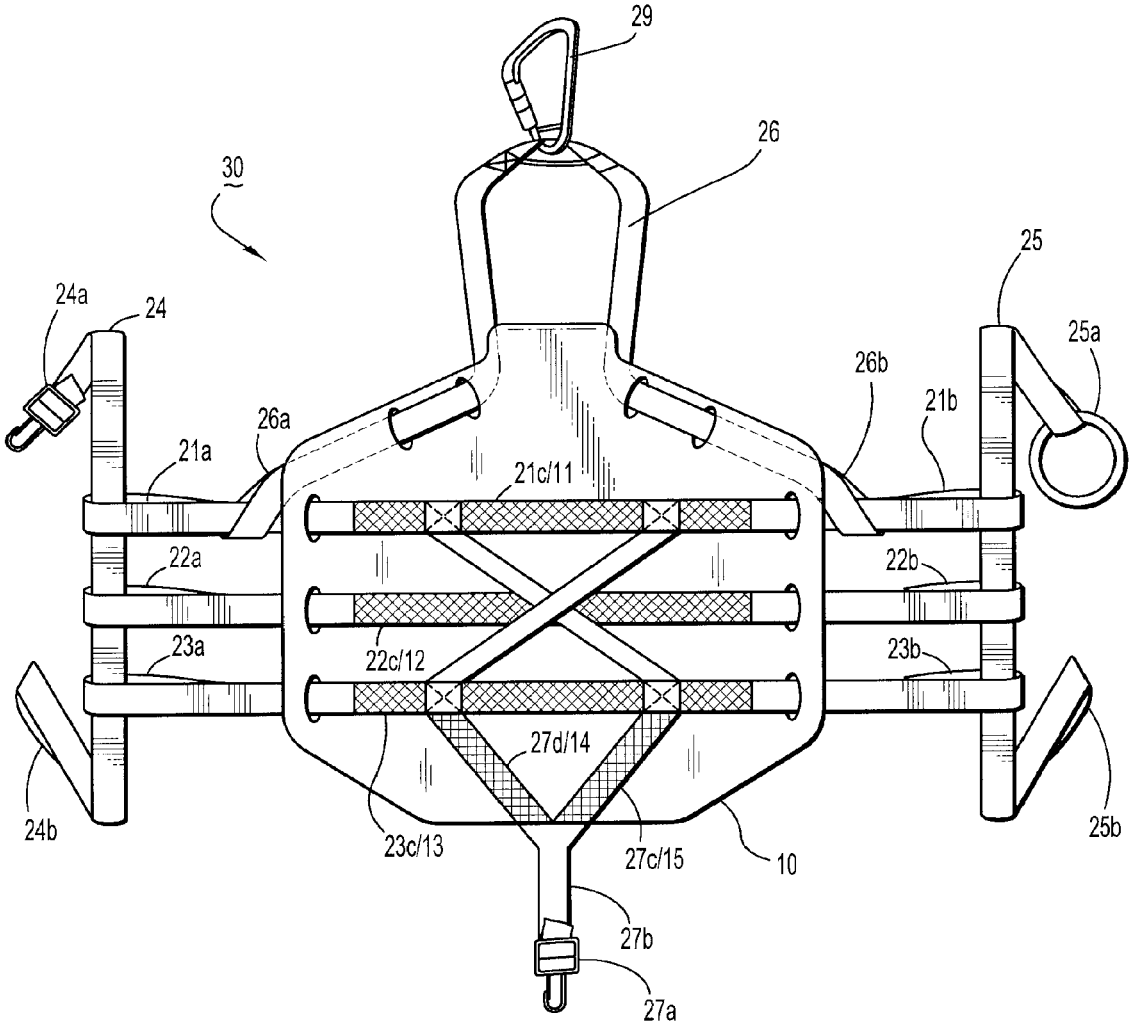
FIG. 3 schematically illustrates a drag stretcher device according to an exemplary embodiment of the invention, which is formed using the base panel and unitary harness device of FIGS. 1 and 2, respectively.

FIGS. 1, 2 and 3 illustrate a rapid intervention rescue stretcher device according to an exemplary embodiment of the invention. In particular, FIG. 3 schematically illustrates a rescue stretcher device (30) according to an exemplary embodiment of the invention, which comprises a base panel (10) formed of a flexible sheet material (as separately shown in FIG. 1) and a unitary harness system (20) (as separately shown in FIG. 2). The base panel (10) is formed of a flexible sheet material having a top end (T) and bottom end (B). The base panel (10) may be formed of any suitable material (such as pliable plastic materials, polyurethane, or other materials commonly used in the art) that provides a desired durability, relative hardness, and/or flexibility, depending on the application.

The base panel (10) comprises a plurality of harness strap holes (10*a*) formed at various positions along a first side edge and a plurality of harness strap holes (10*b*) formed at various positions along a second side edge of the base panel (10). As explained below, the harness strap holes (10*a*, 10*b*) (or strap slots) are designed to insertably receive portions of the harness straps in manner that allows a unitary harness device (such as shown in FIG. 2) to be coupled to the base panel (10) by lacing strap elements of the harness device through the holes (10*a*, 10*b*). The harness strap holes (10*a* 10*b*) can be cut or otherwise stamped in the sheet material forming the base panel (10) and such strap holes can be reinforced using metal (e.g., brass, stainless steel, etc.) or plastic grommets. Moreover, the base panel (10) comprises strips of Velcro (11, 12, 13, 14, 15) strategically placed in position to interface with mating Velcro strips affixed to regions along the various straps of the unitary harness device and further service to hold the unitary harness system in position on the base panel (10). The Velcro strips (11~15) can be glued to the base panel (10).

FIG. 2 illustrates an exemplary unitary harness system (20) according to an exemplary embodiment of the invention, which may be used with the exemplary base panel (10) of FIG. 1. The unitary harness system (20) comprises elongated cross-body straps (21, 22, 23) (or waist straps), elongated holding straps (24, 25), a pull handle strap (26) (or tow handle), and a groin strap (27). The elongated body straps (21, 22, 23) each have respective looped ends (21*a*, 21*b*), (22*a*, 22*b*) and (23*a*, 23*b*). A portion of respective body straps (21, 22, 23) may have Velcro strips (21*c*, 22*c*, 23*c*) attached thereto, which are designed to mate with corresponding Velcro strips (11, 12, 13) affixed on the base panel (10). The elongated body straps (21, 22, 23) are connected together by box stitching a cross-strap (28) as shown.

The elongated holding strap (24) comprises a metallic locking clip fastener (24*a*) (e.g., snap clip) connected on one end thereof and a looped end (24*b*). The elongated holding strap (25) comprises a metallic ring fastener (25*a*) (e.g., bull ring) connected on one end thereof and a looped end (25*b*). The handle strap (26) comprises an elongated length of strap material having first and second looped ends (26*a*) and (26*b*). A metallic connector (29) (e.g., carabineer) may be used to enable the handle strap (26) to be connected to a safety line device or other equipment, otherwise the handle (26) can be physically pulled by hand.

The groin strap (27) includes clip fastener (27*a*) and strap portions (27*b*, 27*c*, 27*d*) where the clip fastener (27*a*) is attached to one end of strap portion (27*b*) and where strap portions (27*c*) and (27*d*) may have strips of Velcro attached thereto which are designed to mate with corresponding Velcro strips (14) and (15) on the base panel (10). The ends of the strap portions (27*c*) and (27*d*) are box stitched to the elongate body strap (23). It should be understood that the cross-straps (28) and groin strap portions (27*c*) and (27*d*) may be formed by two elongated lengths of strapping which are arranged and box stitched to the elongated body straps (21, 22, 23) in a way to form the cross strap layout with extended pieces forming the strap portions (27*c*) and (27*d*). The groin strap (27) may have a ring connector connected to the groin strap portion (27*b*) (e.g., at point where all strap portions (27*b*, 27*c* and 27*b*) meet, allowing connection to another carabineer (29) clip of another drag stretcher device so as to form a connecting chain of drag rescue stretchers that can be pulled together in, e.g., mass casualty situations so as to extricate multiple injured or dead persons from a given location.

The unitary harness device (20) may be formed of any suitable strapping or webbing material that is rated for a desired strength and durability for the intended purposes. For example, in firefighting applications, the harness straps forming the unitary harness device (20) may be formed of a flexible, 1"~2" tubular webbing that is formed of non-abrading and flame-resistant material using, for example, aramid fibers such as Kevlar® and Nomex®. In other applications, the harness straps may be formed of nylon, polyester or other suitable materials.

FIG. 3 illustrates a drag rescue stretcher device (30) which comprises an assembly of the exemplary base panel (10) and unitary harness device (20), wherein the unitary harness device (20) is removably connected to the base panel (10) by lacing portions of the harness straps through the strap holes in the base panel (10) and coupling the mating Velcro strips on the harness straps to the Velcro strips on the base panel (10). In particular, in the exemplary embodiment of FIG. 3, the unitary harness device (20) can be coupled to the base panel (10) by inserting the looped ends (21*a*, 22*a*, 23*a*) of the elongated straps (21, 22, 23) through corresponding strap holes (10*a*) on the left peripheral side edge of base panel (10) and by inserting the looped ends (21*b*, 22*b*, 23*b*) through corresponding strap holes (10*b*) on the right peripheral side edge of the base panel (10). The unitary harness (20) is held in place on the base panel (10) via the corresponding mating Velcro strips (21*c*/11), (22*c*/12), 23*c*/13), (27*c*/15) and (27*d*/14) that are stitched to the portions of the elongate straps (21, 22, 23) and glued to the base panel (10).

Moreover, the pull handle strap (26) is laced through corresponding strap holes on the base panel (10) by inserting the looped end (26*a*) of the pull handle strap (26) through the upper strap holes (10*a*) and by inserting the looped end (26*b*) of the pull handle strap (26) through the upper strap holes (10*b*). The pull handle strap (26) is coupled to the harness waist straps by, e.g., inserting the looped end (21*a*) of the elongated body strap (21) through the looped end (26*a*) of the handle (26), and by inserting the looped end (21*b*) of the elongated body strap (21) through the looped end (26*b*) of the pull handle strap (26), as shown in FIG. 3. The holding strap (24) is laced through the looped ends (21*a*, 22*a*, 23*a*) of the elongated body straps (21, 22, 23) and the holding strap (25) is laced through the looped ends (21*b*, 22*b*, 23*b*) of the elongated body straps (21, 22, 23).

The drag rescue stretcher (30) can be deployed as follows. An injured person is placed onto the base panel (10) with his/her back torso region aligned to the base panel (10). When maneuvering the person onto the base panel (10), the harness device (20) will be maintained in proper position on the base panel (10) by, e.g., the Velcro strip connections between the harness device (20) and base panel (10). When the person is in proper position, the loose end of the groin strap portion (27*b*) with the clip fastener (27*a*) is passed between the person's legs in the groin region such that the clip (27*a*) is brought to the front torso region of the person. Moreover, the clip fastener (24*a*) of the holding strap (24) is passed through the looped end (24*b*) to form a closed loop and the clip fastener (24*a*) is brought to the front torso region of the person. Similarly, the ring fastener (25*a*) of the holding strap (25) is passed through the looped end (25*b*) to form a closed loop, and the ring fastener (25*a*) is brought to the front torso region of the person, where the clip fastener (24*a*) and (27*a*) are connected to the ring fastener (25*a*). In this manner, the unitary harness (20) essentially encloses and surrounds the torso region of the person. The lengths of the elongated body straps (21, 22, 23) and holding straps (24) and (25) are preferably designed such that the unitary harness device (20) is relatively tightly secured around the torso region of the person upon connection of the clips (24*a*) and (27*a*) to the ring (25*a*) with the side portions of the base panel (10) being drawn against the sides of the person.

Figure 4:
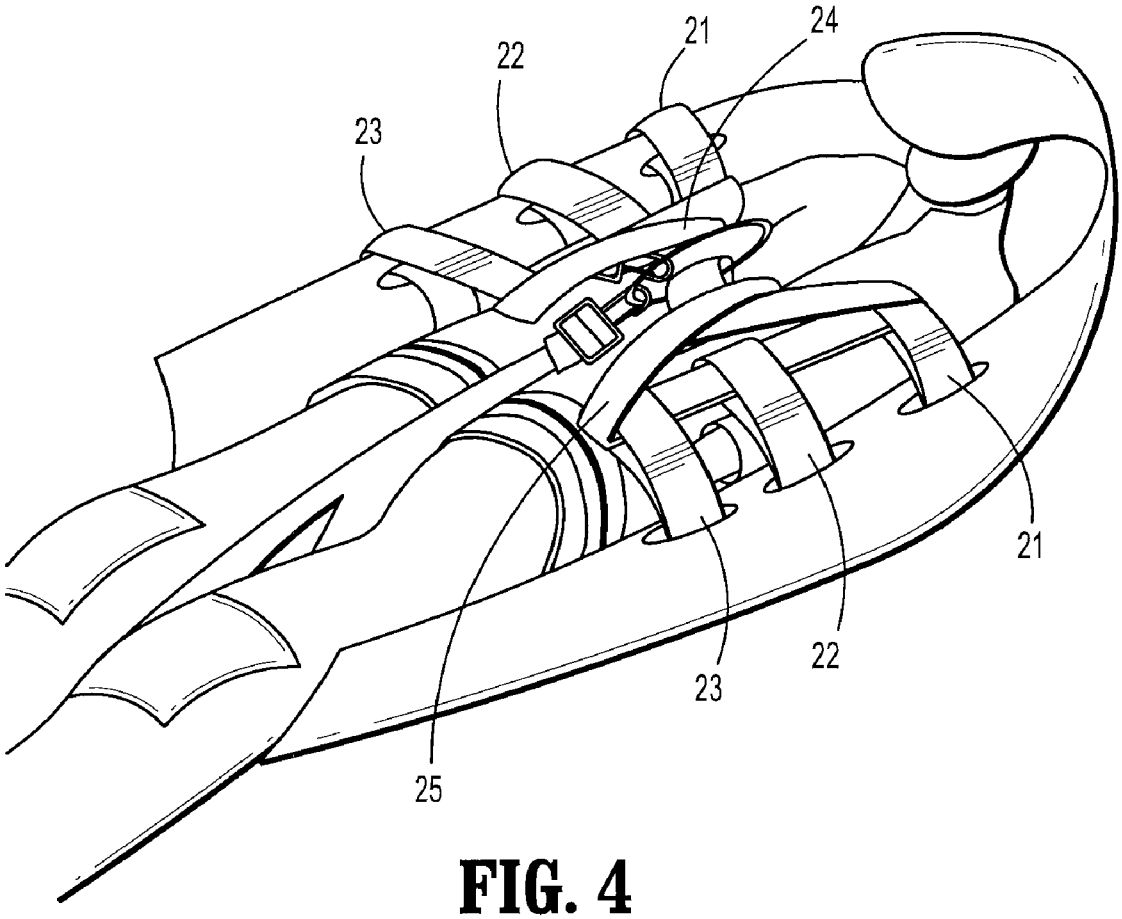
FIG. 4 is a perspective view of the assembly of FIG. 3 operatively supporting an injured person.

FIG. 4 is a perspective view of the assembly of FIG. 3 operatively deployed to secure an injured person. In operation, the drag rescue stretcher can be used to drag an individual where the base panel (10) is designed to readily slide over various surfaces while protecting the back and side torso regions of the individual. Moreover, the drag rescue stretcher (30) can be used for vertical lift applications where the carabineer (29) is hooked to a haul line to pull the person out of a hole or up a flight of stairs, for example. The dimensions of the base panel (10) can vary depending of the application. For example, the overall width of the base panel (10) can be made sufficiently wide to wrap around the sides and backside of a person's torso (such as shown in FIG. 4). Moreover, the base panel (10) may have a length that is sufficient to receive and support substantially the head and torso region of a person (but not necessarily the legs), such as shown in FIG. 4. With this exemplary embodiment, the injured person's legs and hips can freely bend while secured to the stretcher device (30), which facilitates extrication from confined places and where tight turns must be navigated, e.g., firefighting applications where an injured firefight must be dragged through winding hallways of a burning home or building. In other instances, the base panel (10) can have a length to provide a full-body length drag stretcher device.

The pull handle strap (26) is used to pull the drag rescue stretcher (30) while the person is secured therein. In the exemplary embodiment of FIG. 3, the pull strap handle (26) is not fixedly attached to the base panel (10) and does not pull directly on the base panel (10) during a drag or lift operation. Instead, the looped ends (26*a*, 26*b*) of the harness handle (26) are slideably attached to the looped ends (21*a*, 21*b*) of the upper elongated body strap (21) such that in effect, the handle (26) actually pulls on the unitary harness system (20) in which the individual is secured. In the exemplary embodiment of FIG. 3, the pulling of the handle (26) operates to remove slack and more tightly secure and cinch the unitary harness device (20) around the torso region. The clip fasteners (24*a*) and (27*a*) on the holding strap (24) and groin strap (27) may allow for adjustment of the length of the strap members (24) and (27), so as to accommodate for persons of different size and bulk, and to permit a person to be more positively secured, while using the pulling action of the handle on the elongated body strap (21) to effectively remove any slack in the unitary harness system (20) and more tightly cinch the unitary harness (20) around the person.

Figure 5:
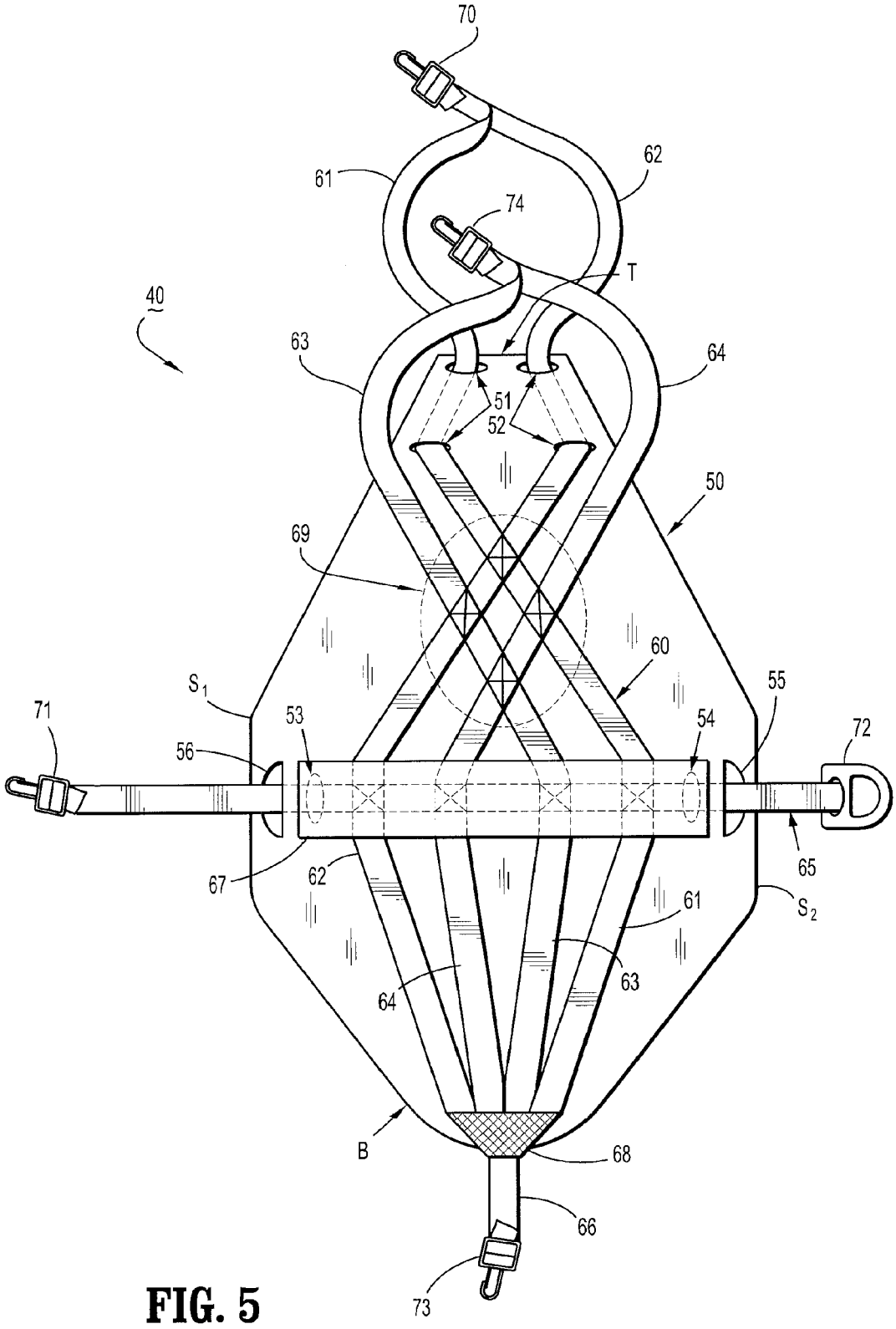
FIG. 5 schematically illustrates a drag stretcher device according to another exemplary embodiment of the invention.

FIG. 5 illustrates a drag rescue stretcher device (40) according to another exemplary embodiment of the invention, which comprises an assembly of a base panel (50) and a unitary harness device (60). In general, the base panel (50) is formed of a flexible sheet material having a plurality of apertures (51, 52, 53, 54, 55, 56) formed at top T and side regions S1, S2 of the base panel (50). The apertures (51, 52, 53 and 54) are preferably formed as thin slots to insertably receive harness straps of the unitary harness system (60). The apertures (55, 56) are preferably formed to serve as handles that enable a person to grab the drag stretcher base panel (50) by hand when necessary. The unitary harness system (60) comprises elongated straps (61, 62, 63, 64) that extend between top T and bottom B ends of the base panel (50), an elongated waist strap (65) that extends between sides S1 and S2 of the base panel (50), a groin strap (66) that is disposed at the bottom region of the base panel (50), and a support pad (67) (lumber support).

At the top region of the base panel (50), end portions of the elongated straps (61) and (62) are looped through respective aperture pairs (51) and (52) and are connected to form a pull handle strap. A metallic connector (70) (e.g., tri-bar connector) may be used to connect the end portions of straps (61) and (62) and to assist in dragging. Other means for connecting the ends of straps (61, 62) may be used to form the strap loop, such as connecting the ends of the straps (61) and (62) via a water knot (70') (see FIG. 6), depending on the application. The metallic connector (70) may enable the handle strap to be connected to a safety line device or other equipment, otherwise the handle strap can be physically pulled by hand.

Figure 6:
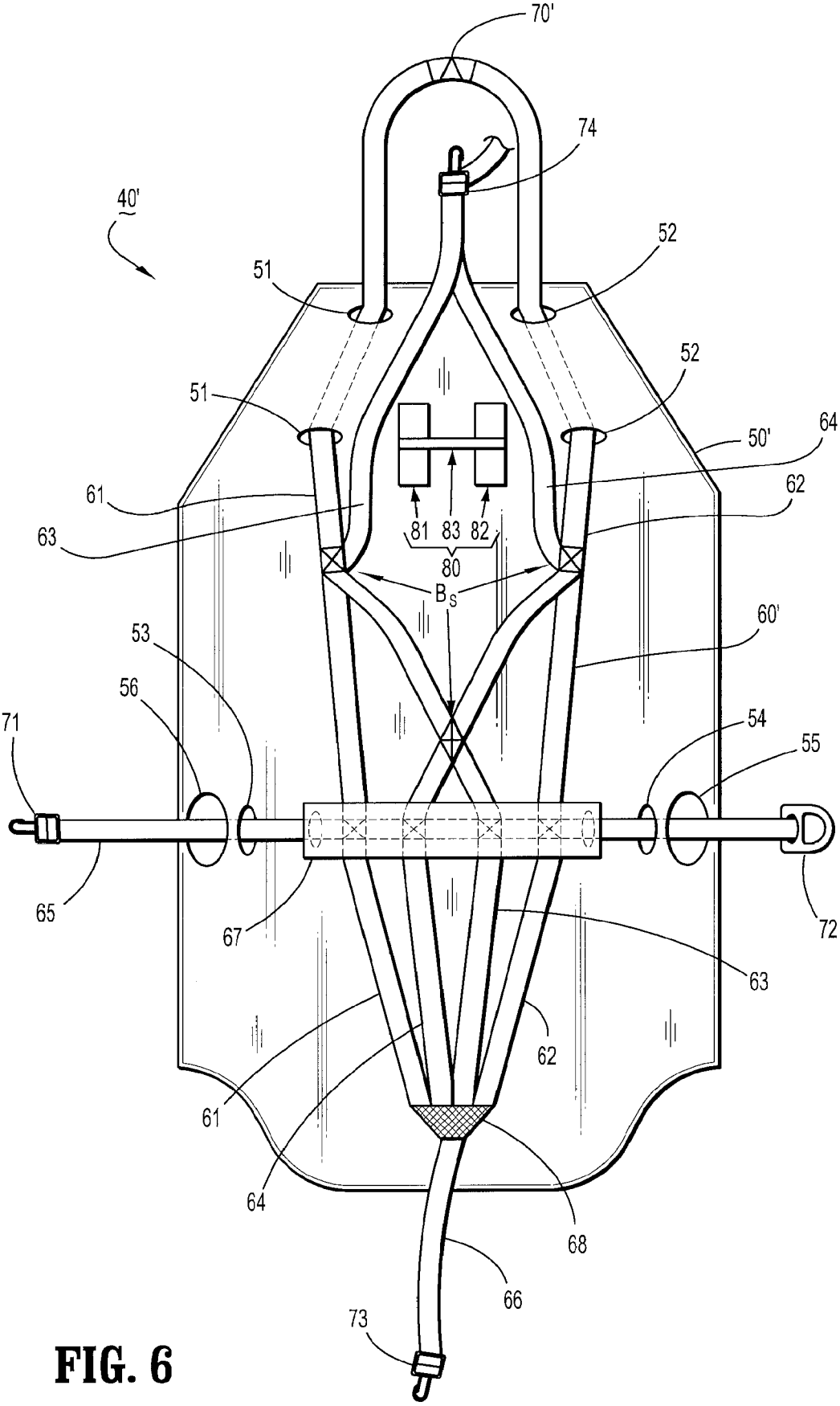
FIG. 6 schematically illustrates a drag stretcher device according to another exemplary embodiment of the invention.

Moreover, end portions of the elongated straps provide a pair of shoulder straps (63) and (64) that are connected at distal ends thereof via a clip fastener (74) to form shoulder harness straps, as shown in FIGS. 5-9. The elongated straps (61, 62, 63 and 64) are connected to each other via box stitching and arranged in a criss-cross pattern in region (69), as shown in FIG. 5. The elongated straps (61, 62, 63, and 64) are further fixedly attached (via stitching or other means) to the backside of the support pad (67), as shown in FIGS. 5-6. The end portions of the elongated straps (61, 62, 63 and 64) converge at the bottom region of the base element (50) and are connected to an end of the groin strap (66) via box stitch connection region (68), as shown in FIGS. 5-7 and 9. Proximal ends of each strap of the pair of shoulder straps are fixedly connected to a proximal end of the groin strap at the box stitch connection region (68). The groin strap (66) includes any suitable clip fastener (73).

The straps (61) and (62) may be formed by one continuous strap element, which is folded and stitched at the box stitch connection region (68). Similarly, the elongated strap members (63) and (64) may be formed from one continuous length of strap, which is folded and stitched at the box stitch connection region (68). The groin strap (66) may be an extended looped portion of the continuous strap element (63, 64). The waist strap (65) is fixedly attached (via box stitching) to the backside of the support pad (67). A first end of the waist strap (65) is looped through the aperture (53) and handle (56) and comprises a metallic locking clip fastener (71) (e.g., snap clip). A second end of the waist strap (65) is looped through the aperture (54) and handle (55) and comprises a metallic ring fastener (72) (e.g., bull ring) connected thereto to provide a single fastener to couple each end portion of each harness strap when securing an individual within the rescue harness.

The unitary harness system (60) may be removably connected to the base panel (50) by inserting the ends of the elongated waist strap (65) through corresponding apertures (53), (54), (55), and (56) of base panel (50) and by inserting the ends of elongated straps (61) and (62) through corresponding apertures pairs (51) and (52) of base panel (50), as shown in FIG. 5. The unitary harness system (60) may be held in place on the base panel (50) via Velcro strips that are stitched along portions of the backsides of elongate straps (61, 62, 63, 64) in the upper torso and groin regions and on the backside of the support pad (67), and respective mating Velcro strips that are affixed to the surface of the base panel (50).

The unitary harness system (60) may be formed of any suitable strapping or webbing material that is rated for a desired strength and durability for the intended purposes. For example, in firefighting applications, the unitary harness strap (20 may be a flexible, 1"~2" tubular webbing that is formed of non-abrading and flame-resistant material using, for example, aramid fibers such as Kevlar® and Nomex®. In other applications, the harness straps may be formed of nylon, polyester or other suitable materials. The support pad (67) may be formed using material commonly used for lumbar support belts, woven elastic materials, etc.

The drag rescue stretcher (40) can be deployed as follows. An injured person is placed onto the base panel (50) with his/her back torso region aligned to the base panel (50). When maneuvering the person onto the base panel (50), the unitary harness (60) will be maintained in proper position on the base panel (50) by, e.g. the Velcro strip connections between the harness straps and base panel. When the person is in proper position, the loose end of the groin strap (66) with the clip fastener (73) is passed between the person's legs in the groin region such that the clip (73) is brought to the front torso region of the person. Moreover, the clip fastener (71) of the waist strap (65) is brought to the front torso region of the person. Similarly, the ring fastener (72) of the waist strap (65) is brought to the front torso region of the person, where the clip fasteners (71) and (73) are connected to the ring fastener (72). Moreover, the shoulder strap loop formed by the connected ends of elongated straps (63) and (64) is looped over the person's head and shoulders, whereby the clip fastener (74) is brought to the front torso region and connected to ring fastener (72). In this manner, the unitary harness (60) essentially encloses and surrounds the torso region of the person. The exemplary unitary harness system (60) can be designed to meet NFPA standards for class III operation. In other embodiments, a head support/strap system can be integrally connected to the base panel (50) in an upper region of the base element (50) using known techniques and devices.

In other embodiments, the strap elements (61, 62, 63 and 64) may be arranged in region (69) in some layout other than the criss-cross pattern (69) depicted in FIG. 5. The criss-cross pattern is advantageous to provide back support when a person is strapped in the drag stretcher (40). The strap elements (61) and (62) may be arranged to extend down either sides of the base element (50) without crossing each other in region (69). For example, FIG. 6 schematically illustrates another exemplary embodiment of a drag rescue stretcher device (40') comprising an assembly of a unitary harness device (50') and base panel (60'), which is similar in design to that of FIG. 5. In FIG. 6, the harness straps (61, 62, 63, 64) in the upper torso region are connected to each other at box stitch regions Bs, as depicted in FIG. 6, but not formed in a criss-cross pattern (69) as in FIG. 5. FIG. 6 further illustrates an exemplary head restraint device (80) comprising adjacent head pad restraint elements (81) and (82) between which a person's head is disposed and strapped in secured position by a strapping element (83), as is known in the art.

Figure 7:
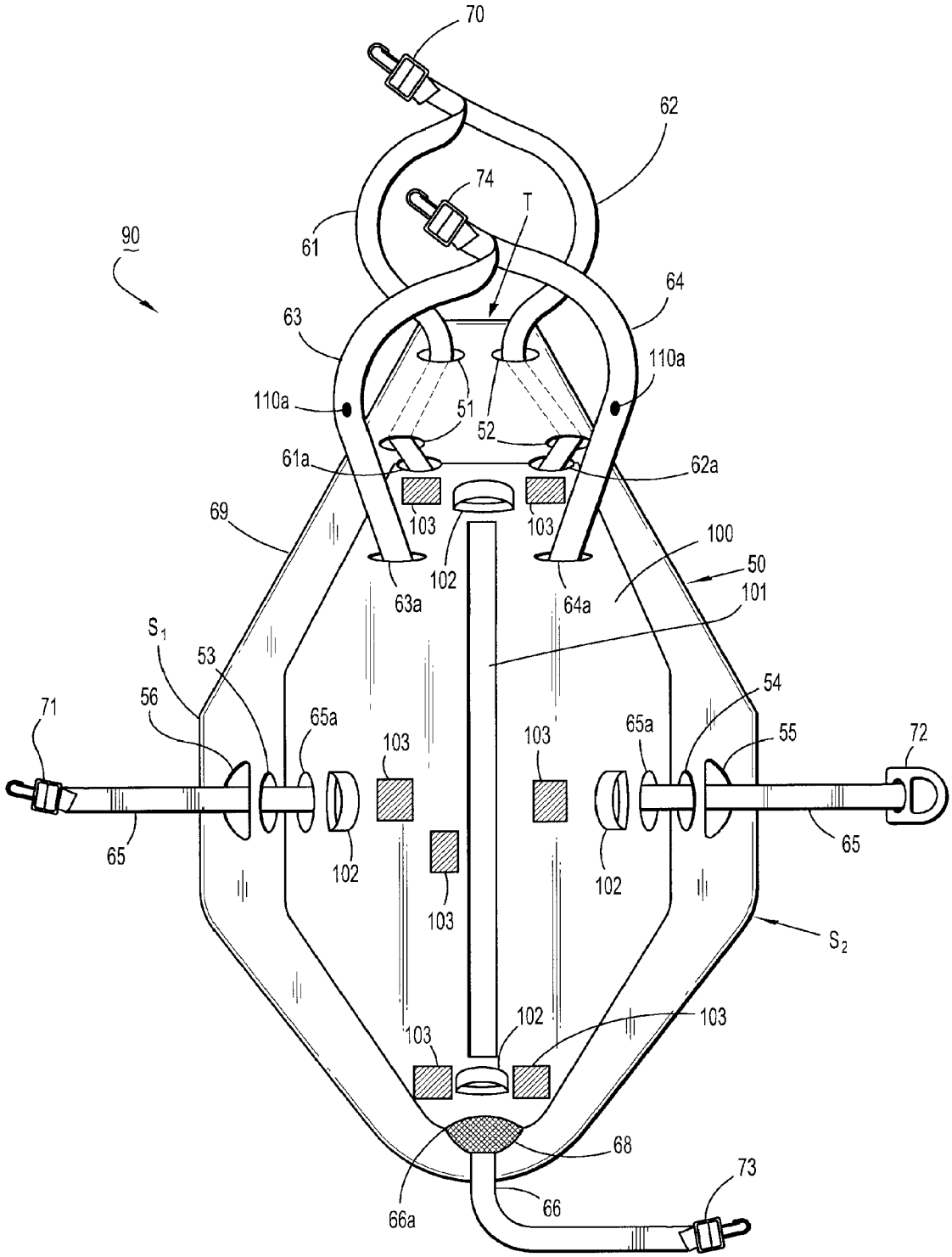
FIGS. 7, 8 and 9 schematically illustrate a drag stretcher device according to another exemplary embodiment of the invention.
Figure 8:
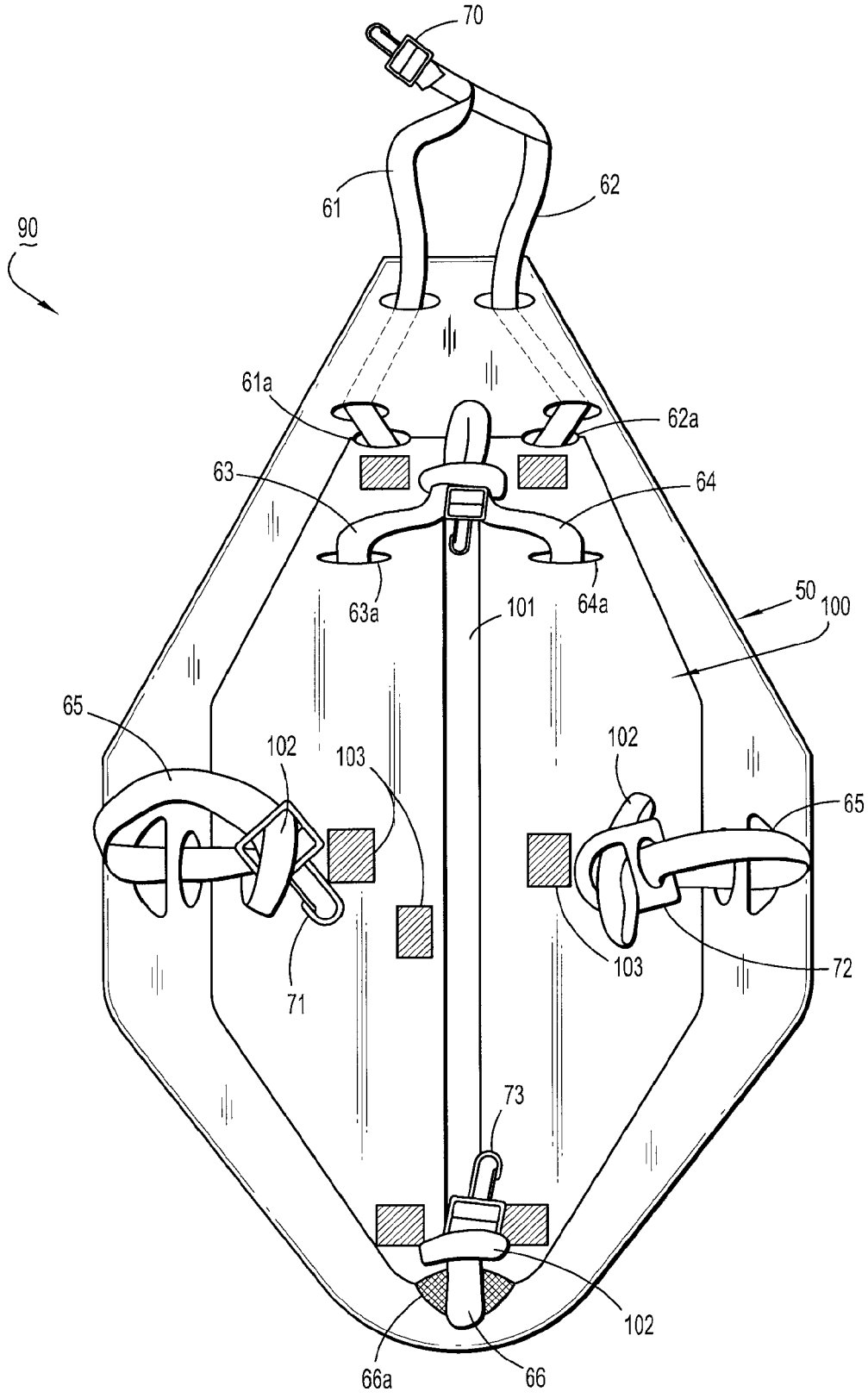
Figure 9:
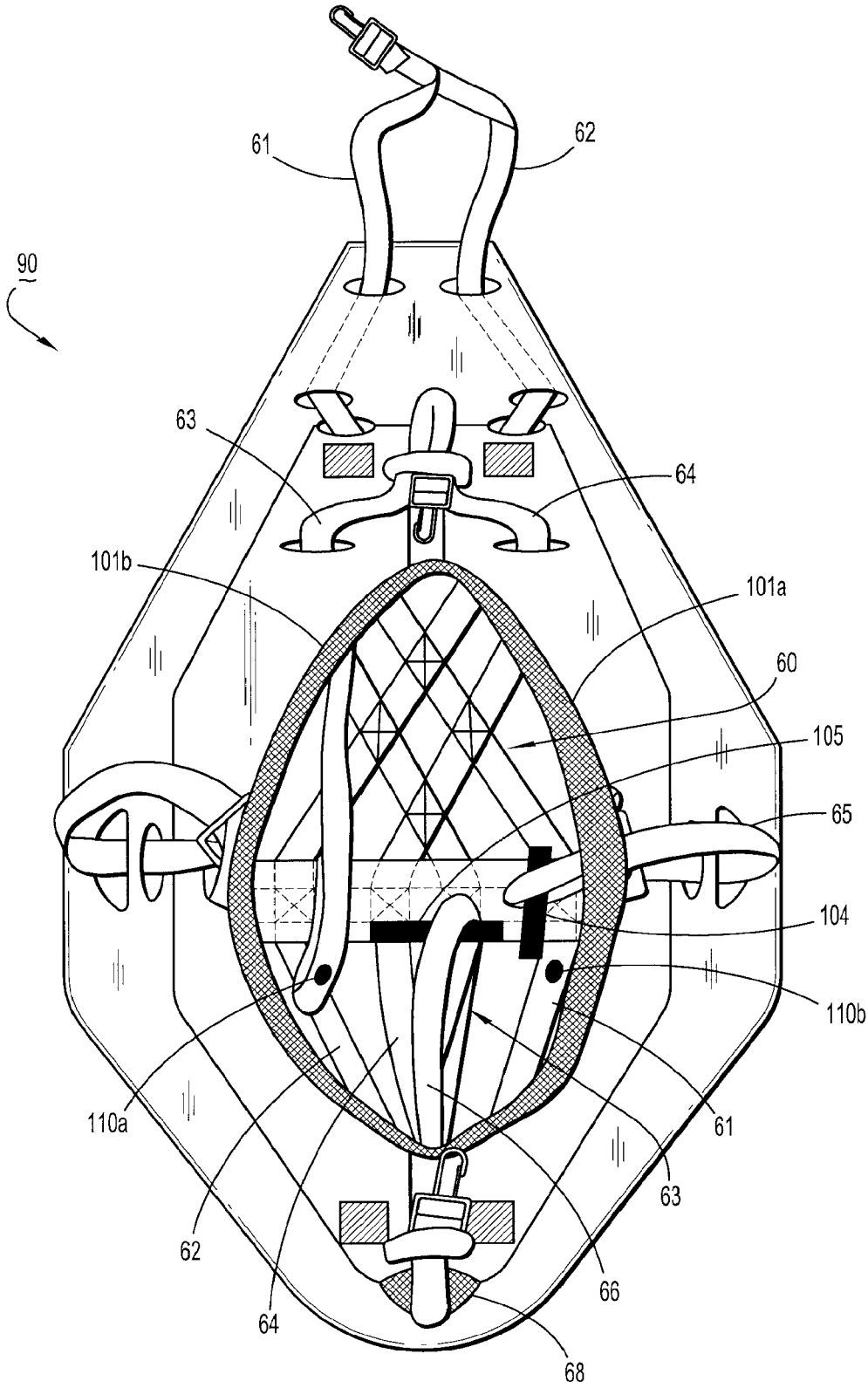

In other exemplary embodiments of the invention, unitary harness systems are formed with harness housings (or harness bags) that serve various functions such as providing protection for harness webbing and storage for loose straps when the harness device is not deployed. For instance, FIGS. 7, 8 and 9 schematically illustrate a rescue stretcher device (90) according to another exemplary embodiment of the invention, which is an extension of the rescue stretcher device of FIG. 5 comprising base panel (50) and the unitary harness system (60) that further includes harness housing (100). The harness housing (100) is essentially a "bag" having at least a bottom and top layer of suitable material stitched together around the perimeters thereof and forming an interior cavity that contains the body of the unitary harness system (60). The harness bag (100) comprises a plurality of reinforced slots/slits (61*a*, 62*a*, 63*a*, 64*a*, 65*a*, 66*a*) to allow the end portions of the various harness straps, e.g., haul straps (61, 62), shoulder straps (63,64), waist straps (65) and groin straps (66) of the harness system (60) to extend from within the interior of the harness bag (100).

The harness bag (100) further comprises an elongated reclosable opening (101) formed in the central region of the top surface thereof. In one embodiment, the opening (101) is formed with overlapping mating portions (101*a*) and (101*b*) having mating connector mechanisms (e.g., Velcro strips) (e.g., FIG. 9). The bottom exterior surface of the harness bag (100) may be removably or fixedly attached to the base panel (50) using any suitable connection means. For instance, the harness bag (100) may be removably held in place on the base panel (50) via corresponding mating Velcro strips that are stitched along portions of exterior of the backside of the harness bag (100) and corresponding Velcro strips glued to portions on the surface of the base panel (50). The harness bag (100) further comprises a plurality of strap fasteners (102) disposed on the exterior surface of the top layer of the bag (100) in proximity to each of the slots/slits (61*a*, 62*a*, 63*a*, 64*a*, 65*a*, 66*a*), and a plurality of reflective patches (103) formed in proximity to each of the fasteners (102).

As depicted in FIG. 8, when the rescue stretcher device (90) is not being used, the excess slack of the various straps, e.g., haul straps (61, 62), shoulder straps (63, 64), waist straps (65) and groin straps (66) of the harness device (60) may be contained within the harness bag (100) while the fasteners (102) are used to hold the end portions of the straps with the respective fasteners in a fixed position on the exterior surface of the upper layer of the harness bag (100) in proximity to the corresponding strap slits. The fasteners (102) may be Velcro straps, for example, having one end stitched to the exterior surface of the top layer of the bag (100) and Velcro connectors on the other ends to strap down and hold the harness strap fasteners of the harness straps. In other exemplary embodiments, the harness strap fasteners disposed on the exterior of the bag (100) may be stowed in pockets that are formed on the upper exterior surface of the bag (100) in proximity to the strap slits of the harness bag (100).

FIG. 9 illustrates the device in FIG. 8 in a non-deployed arrangement, with the overlapping mating sides (101*a*, 101*b*) being shown separated along a length of the reclosable opening (101) to enable access the portion of the harness body contained within the interior of the harness bag (100). When in the non-deployed arrangement, the excess slack of the elongated straps (63, 64, 65, 66) stored inside the bag (100) can be held in place using holding straps (104, 105) or mating snap button connectors (110*a*, 110*b*). In particular, as shown in FIG. 9, the excess slack of the waist strap (65) can be held in place inside the bag (100) using a strap fastener (104) (e.g., Velcro strap). Similarly, a strap fastener (105) can be used to hold the excess slack of the groin strap (66) inside the harness bag (100). Moreover, the excess slack of the shoulder straps (63) and (64) can be held in place by connecting the mating snaps (110*a*) on the straps (63, 64) to mating snaps (110*b*) connected to the lower straps (61, 62) along the lengths between the support waist band (67) and the box stitch connection region (68). It is to be understood that for purposes of clarity, FIG. 9 does not show excess slack of the haul straps (61, 62) and should strap element (64) being stowed and held in position inside the harness bag (100), although the excess slack of such harness straps can be releasably held in position inside the harness bag (100) using snaps and strap mechanisms similar to that discussed herein.

When deploying the rescue stretcher device (90) from the arrangement in FIG. 8, a person would open the bag (100) via the opening (101) as depicted in FIG. 9, and then unfasten the straps (104), (105) and unsnap the snap connections (110*a*, 110*b*) (and other fasteners not specifically shown) to release the slack of the various harness straps (61, 62, 63, 64, 65, 66). Thereafter, the person could reclose the opening (101) and then release the straps (102) on the exterior upper surface of the bag (100) and then pull on the fastener ends of the various straps and pull out the excess slack of the harness straps (61, 62, 63, 64, 65, 66), position the individual on top of the harness bag (100) and then securely strap the individual into the unitary harness system (60) as discussed above. In dark or low visibility conditions, reflective patches (103) on the external surface of the bag (100) would allow one to locate the strapped ends of the harness straps on the exterior surface of the bag (100) more readily.

In the exemplary embodiment of FIGS. 7-9, the harness bag (100) can be made of any suitable material for the application (e.g., fire retardant material) to protect the unitary harness system (60) under adverse conditions. The harness bag (100) serves to store the unitary harness device in an organized manner when non-deployed so that the harness straps do not get tangled or damaged, etc. The harness bag (100) can be used with unitary harness frameworks (e.g., the harness system of FIG. 6) other than the exemplary harness system as depicted in FIGS. 7-9.

It is to be appreciated that a unitary harness system with an integral harness bag as depicted in FIGS. 7~9 may be utilized as a stand-alone rescue harness device (e.g., full body harness) independently of a base panel as in rescue stretcher device applications. As a standalone rescue harness system, the harness bag (100) can serve as a container for any rescue harness device used in conjunction with the harness bag, to thereby protect and provide stowage for the harness device, with the harness bag further serving to provide some level of back and upper torso support when the harness system with the integral harness bag is donned and deployed by an individual.

It is to be understood that the exemplary embodiments discussed here are merely illustrative of general conceptual frameworks of a rescue stretcher device or rescue sled comprising a flexible base panel in combination with a unitary harness system, wherein the unitary harness system may include an integral harness bag for protection and stowage of the harness body straps. Unitary harness systems according to exemplary embodiments of the invention can be designed for different applications and can include any type of harness systems such as full-body harnesses or rescue harness frameworks that otherwise meet NFPA (National Fire Protection Association) standards (or other regulatory standards) for Class I, Class II, and/or Class III service, depending on the application. In this regard, although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

We claim:

1. A rescue stretcher comprising:

a base panel formed of flexible sheet material; and a unitary harness system coupled to the base panel;

wherein a plurality of harness straps are coupled to the unitary harness system, the plurality of harness straps including a groin strap, shoulder straps and a waist strap, wherein a first end of the waist strap includes a fastener and a second end of the waist strap includes a ring fastener, and wherein an individual is secured in the rescue stretcher by:

a) the waist strap looped around the individual and the waist strap fastener directly connected to the waist strap ring fastener, b) the groin strap looped around the individual and directly connected to the waist strap ring fastener, and c) the shoulder straps looped around the individual and directly connected to the waist strap ring fastener.

2. The rescue stretcher of claim 1, wherein the unitary harness system is removably coupled to the base panel using a hook and pile fastening mechanism.

3. The rescue stretcher of claim 1, wherein the unitary harness system is a full body harness.

4. The rescue stretcher of claim 1, wherein the unitary harness system is adapted to be secured around the individual by pulling on a handle to remove slack in the unitary harness system and cinch the unitary harness system around the individual.

5. The rescue stretcher of claim 1, wherein the unitary harness system comprises:

a harness bag having an interior cavity to contain and protect a harness of the unitary harness system; and one or more pull straps that extend through slits from within the harness bag that form a pull handle of the rescue stretcher device, wherein the harness bag comprises a plurality of slits to allow end portions of the harness straps to extend from within the interior cavity of the harness bag and mateably couple to securely restrain the individual within the harness, wherein the harness bag comprises an elongated reclosable opening to enable access to a portion of the harness fixedly contained within the harness bag, and wherein a groin strap, shoulder straps and a waist strap are fixedly connected within the harness bag.

6. The rescue stretcher of claim 5, wherein the harness bag comprises a plurality of reflective patches disposed on the exterior surface of the harness bag in proximity to each of the slits.

7. The rescue stretcher of claim 5, wherein the harness bag is removably coupled to a base panel using a hook and pile fastening mechanism.

8. The rescue stretcher of claim 5, wherein at least a portion of the unitary harness is fixedly secured to an inner surface of the interior cavity of the harness bag.

9. The rescue stretcher of claim 5, wherein the harness bag comprises a plurality of fastener devices disposed on an exterior surface of the harness bag in proximity to each slit to releasably hold in place the end portions of the harness straps when the harness is not deployed.

10. The rescue stretcher of claim 5, wherein the harness bag comprises a plurality of fastener devices disposed within the interior cavity of the harness bag to releasably hold in place excess slack of the harness straps within the interior of the harness bag when the harness is not deployed.

* * * * *